United States Patent [19]

Cassiere

[11] 4,432,163

[45] Feb. 21, 1984

[54] ADJUSTABLE MOUNTING SYSTEM FOR PATIO DOORS AND THE LIKE

[75] Inventor: Gerald D. Cassiere, Chicago, Ill.

[73] Assignee: Chamberlain Manufacturing Corporation, Elmhurst, Ill.

[21] Appl. No.: 358,849

[22] Filed: Mar. 17, 1982

[51] Int. Cl.[3] ..... E05B 65/04

[52] U.S. Cl. ..... 49/63; 49/505; 52/217; 52/213

[58] Field of Search ..... 49/505, 504, 63; 52/213, 212, 211, 217

[56] References Cited

U.S. PATENT DOCUMENTS

| | | | |
|---|---|---|---|
| 2,804,954 | 9/1957 | Gillespie | 52/213 |
| 2,970,397 | 2/1961 | Roseman | 49/505 X |
| 3,694,961 | 10/1972 | Johnson | 49/505 X |
| 4,237,665 | 12/1980 | Molyneux | 52/213 |

*Primary Examiner*—Kenneth Downey

*Attorney, Agent, or Firm*—Hill, Van Santen, Steadman & Simpson

[57] ABSTRACT

An adjustable mounting frame for supporting a storm glass assembly exterior of a prime assembly along the clearance edges of a wall opening in a finished building construction utilizes a pair of interdependent frame and support flange pieces. The support flange contains a reversible first surface for facing flush against the exterior portion of the wall and an orthogonal second surface having longitudinal engagement members for connecting with the frame piece. The frame piece has a first side facing the second surface of the flange formed with a plurality of connection elements for slidably attaching the frame piece to the flange and a second side facing into the opening with mounting groove means for supporting the storm glass assembly. The number of connection elements exceeds the number of engagement members on the flange such that the relative relation of the frame and flange pieces is selectively adjustable to permit suitable clearance space between the prime assembly and the storm glass assembly in the wall opening.

4 Claims, 12 Drawing Figures

ADJUSTABLE MOUNTING SYSTEM FOR PATIO DOORS AND THE LIKE

BACKGROUND OF THE INVENTION

The invention relates to an adjustable mounting system particularly useful for adding a patio storm door or storm windows to a finished home construction whether new or used.

In this era of energy conservation, it has become increasingly desirable to install storm windows and storm doors in new or used homes and other buildings not originally containing these features. Storm windows and storm doors can reduce heat loss through bare or prime windows and doors as much as 50 percent, as well as reducing drafts, condensation, and icing. Unfortunately, exterior window and door frames are variously constructed such that the amount of interior or exterior surface in which to mount the storm window or storm door over the original window or door widely differs. This has led to increased costs for the installation of a storm window or door in that special pre-framing mounting systems must be built to adapt wall opening exposed surfaces for installation of the storm window or door.

The present invention is directed to an adjustable mounting system for storm windows and doors, especially patio storm doors, that virtually eliminates the need for individual pre-framing or additional sill construction before installation. The inventive mounting system is variably adjustable for adapting to the original window or door openings of various constructions.

SUMMARY OF THE INVENTION

A system for mounting a storm glass assembly, such as a storm window or storm door, to wall surfaces defining a building opening utilizes a pair of individual frame and support flange pieces which fit together to form a border framework for supporting the storm glass assembly. Each support flange is made up of a first surface to be anchored flush against the building wall and a relatively orthogonal second surface having a plurality of spaced-apart longitudinal rib lines for attachment to the corresponding frame piece. The frame piece is positioned along the plane of the second flange surface for facing inwardly along the edge of the building opening. Mounting groove means are formed longitudinally along the inwardly facing exterior surface of the frame for supporting the storm glass assembly. The opposed, outer facing surface of the frame is formed with a plurality of spaced-apart longitudinal channels able to engage with the flange rib lines.

The number of frame channels is greater than the number of rib lines on the flange, so that the relative positioning of the frame and support flange pieces is adjustable for adapting to a variety of building opening constructions. In this way, the frame piece can be selectively set relative to the original window or door to achieve an acceptable clearance with the storm glass assembly.

In accordance with the preferred embodiment of the invention, the support flange may be formed with two longitudinal rib line portions and the attachment surface of the frame piece may be formed with four cooperating track line receptacles, which permits six possibilities of relative orientation of the flange to the frame by reversing the method of inserting the flange rib means into the frame tracks. A possible seventh position is provided by eliminating the flange completely and mounting the frame piece flush against the edge of the wall surface defining the building opening.

In instances when the building opening is defined by a base sill member, it is further within the contemplation of the invention to provide a sill extension flange piece having a base surface overlying the top of the sill and mounting means for supporting the storm glass assembly disposed along the base surface. The sill extension flange serves to lengthen the plane of the sill in order to support the bottom of the storm glass assembly at an acceptable clearance within the wall opening from the prime window or door.

DESCRIPTION OF THE PREFERRED EMBODIMENT

Figure 1:
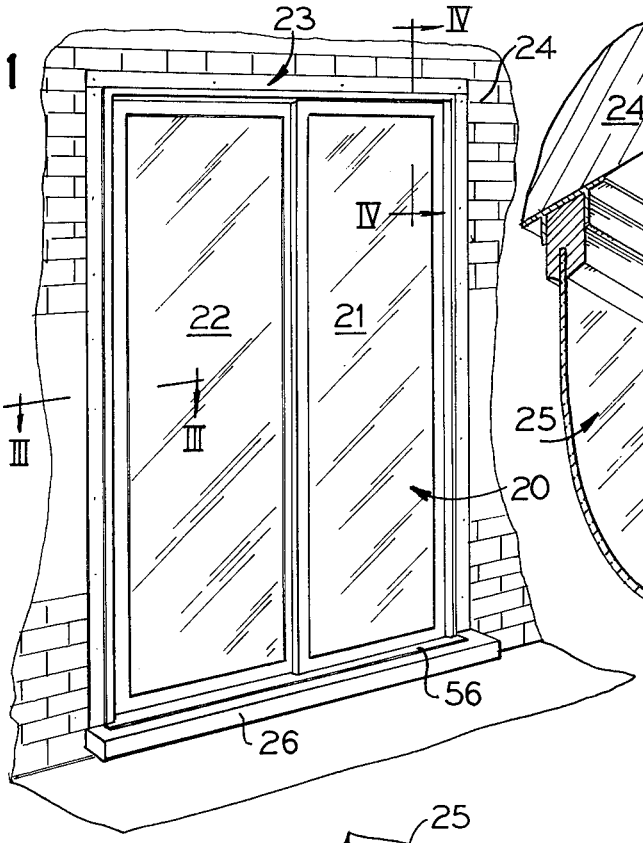
FIG. 1 is a perspective view of a patio storm door in accordance with the present invention over a prime patio door in a patio door opening.

The present invention concerns a selectively adjustable mounting system for storm glass assemblies, such as storm windows and storm doors, adapted for attachment to the wall opening surfaces of finished buildings, such as homes. The principle of the invention is applicable to installation of a storm glass assembly interior or exterior of a building opening; however, for purposes of illustration only an exterior installation application is described below. The invention is hereinafter described in connection with the installation of a patio storm door in a prime patio door wall opening; however, it will be appreciated that the invention may be used in the installation of all forms of storm glass assemblies.

With reference to FIGS. 1–4, there is shown a patio storm door 20 having first and second 21 and 22 glass pane portions mounted laterally adjacent to one another in a mounting frame system 23 constructed according to the present invention for relative back and forth sliding movement. The mounting frame 23 has been attached to corresponding edge surfaces of a brick wall 24 of a home along the edges of the wall which define an original or prime patio door 25. The lower end of the prime patio door opening is defined by a relatively outwardly extending sill or doorstep member 26 made of concrete. In accordance with the invention, the storm door mounting system 23 may be adapted to the patio door opening some time after the house is completed and the edge surfaces of the wall opening exterior of the prime patio door are set.

Figure 2:
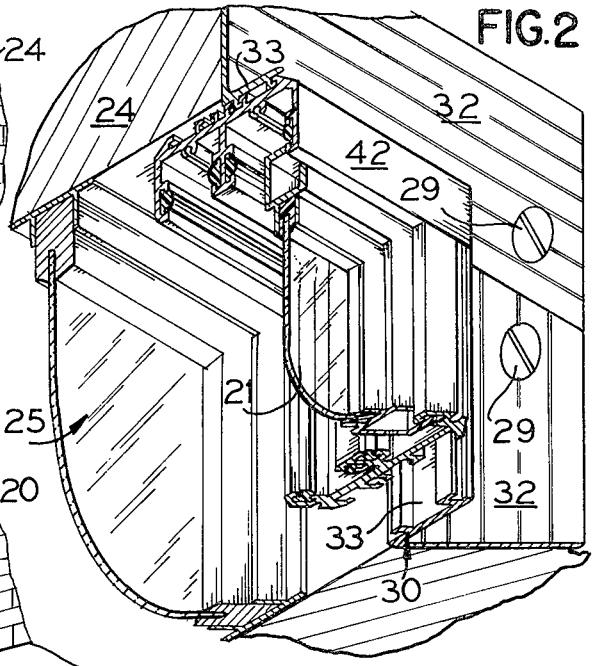
FIG. 2 is a broken-away, perspective view of a corner portion of the patio door opening showing the prime patio door and the inventively mounted storm door of FIG. 1.
Figure 3:
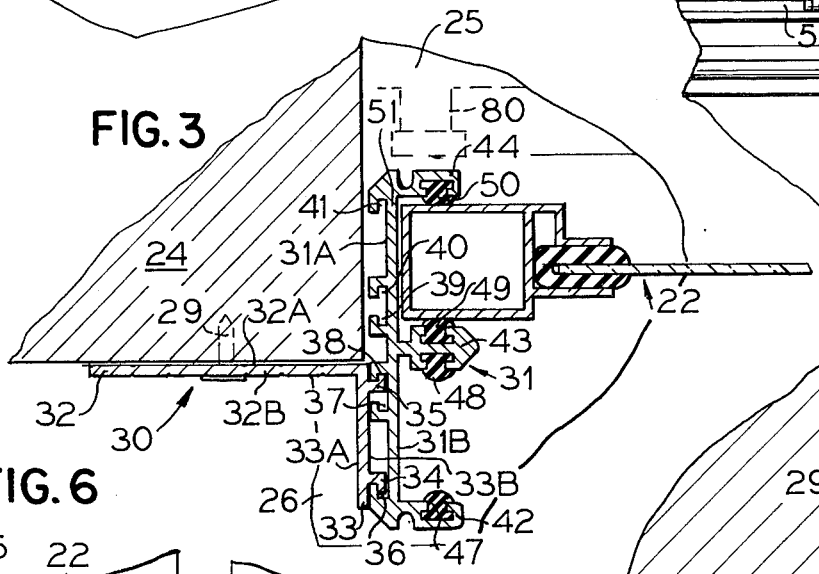
FIG. 3 is a cross-sectional view taken along the lines III—III of FIG. 1.
Figure 4:
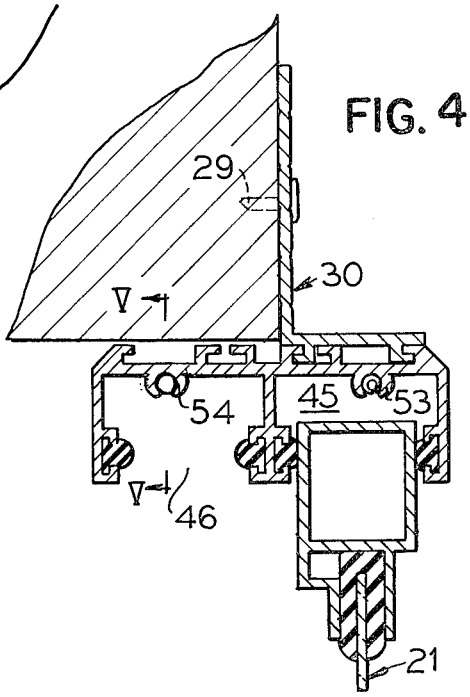
FIG. 4 is a cross-sectional view taken along the lines IV—IV of FIG. 1.

The mounting system 23 along the opposed side upright portions and lateral top portion of the frame are each formed of a two piece construction, namely a support flange piece 30 and a frame member 31. The flange and frame pieces are preferably made of heavy-duty extruded aluminum with a baked-on acrylic enamel finish. Each support flange 30 is an angled member having a first planar surface 32 with opposed sides 32A and 32B, either of which may be mounted flush against the exterior of the wall 24 surrounding the door opening. The support flange piece 30 is fixedly attached to the wall 24 by means of suitable bolt or screws, such as 29, extending through the planar surface 32. Preferably mating orthogonally with the first surface 32 is a second flange surface 33 having a substantially planar side 33A facing the first surface 32 and an opposed interior side 33B facing into the door opening. The inwardly facing side 33B of the flange surface 33 is formed with two laterally spaced, longitudinally directed engagement ribbings 34 and 35, having mirror image L-shaped plan profiles. Depending on which side 32A or 32B of the flange first surface faces the wall 24, the second flange surface 33 extends either outwardly from the door opening, as shown in FIGS. 2–4, or inwardly along the clearance edge portions of the wall defining the opening.

Each frame piece 31 is formed with a first side 31A for facing the interior side 32B of the flange surface 33 and a second side 31B facing into the wall opening. The first side 31A is formed with a plurality of laterally spaced, longitudinally directed connector tracks or channels 36, 37, 38, 39, 40, and 41 defined by corresponding protruding walls having a L-shaped plan profile. The channels 36, 37, and 39 formed on this side of the frame piece 31 are arranged to slidably receive the flange ribbing 34 for cooperative connection of the flange and frame pieces when the side 32A of the flange surface 32 faces flush against the exterior of the brick wall 24. The channels 38, 40, and 41 are arranged to slidably receive the flange ribbing 35 for cooperative connection of the flange and frame pieces when the flange surface side 32A faces the brick wall exterior. When the flange 30 is reversed such that the flange surface side 32B faces flush against the brick wall exterior, the frame channels 38, 40, and 41 may slidably receive the flange ribbing 34 for cooperative connection of the flange and frame pieces and the frame channels 36, 37, and 39 may slidably receive the flange ribbing 35. The number of frame connection channels exceeds the number of engagement ribbings formed on the flange so that the relative relation of the frame 31 in attachment to the flange surface 33 is selectively adjustable for reasons further described below.

The opposed side 31B of the frame piece is formed with laterally spaced, longitudinally extending divider walls 42, 43, and 44 for defining therebetween two side-by-side mounting grooves 45 and 46 in which corresponding exterior edges of the storm door panels 21 and 22 are respectively slidably received for mounting of the patio storm door 20. The opposed end walls 42 and 44 are formed with suitable facing recesses and the central wall 43 is formed with suitable oppositely facing recesses for containing elastic seal liners 47, 48, 49, and 50 which protrude from opposed sides into the frame grooves 45 and 46, respectively, to sealably engage cooperating edge surfaces of the storm door panels.

Figure 5:
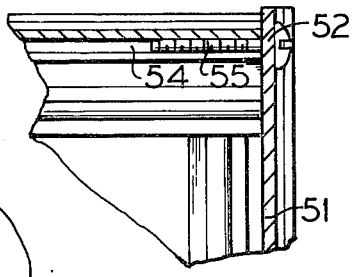
FIG. 5 is a cross-sectional view taken along the lines V—V of FIG. 4.

Aside from the channel members on one side and the divider walls on the other, each of the upright frame pieces mounted in the wall opening contains a generally planar, longitudinal base wall 51. For attachment of the upright and lateral frame pieces at the mating corners of the wall opening, suitably located screw holes 52 are formed through the base wall 51 facing laterally into each of the mounting grooves 45 and 46 at the opposed ends of the upright frame piece. The base walls 51 of the laterally extending frame pieces are formed with longitudinally extending channel members 53 and 54 disposed in the mounting grooves 45 and 46, respectively, for cooperatively mating with the screw holes 52 of the upright frame pieces at their opposed ends. As shown in FIG. 5, metal screws 55 may be inserted through the holes 52 of the upright frame members for receipt in the corresponding ends of the laterally extending frame piece channel members 53 and 54 to lockingly connect the upright and lateral frame pieces together in the wall opening.

The mounting system 23 may utilize support flange and lateral frame pieces along the bottom lateral portion of the wall opening in instances where a storm window is being installed. However, in instances where the bottom edge of the wall opening is defined by a sufficiently protruding sill member, such as the sill 26 in the patio door opening of FIG. 1, it may be adequate to merely mount the frame piece in the case of storm windows or a lateral runner piece 56 in the case of a patio storm door as shown in FIG. 1 directly onto the upper surface of the sill.

Figure 6:
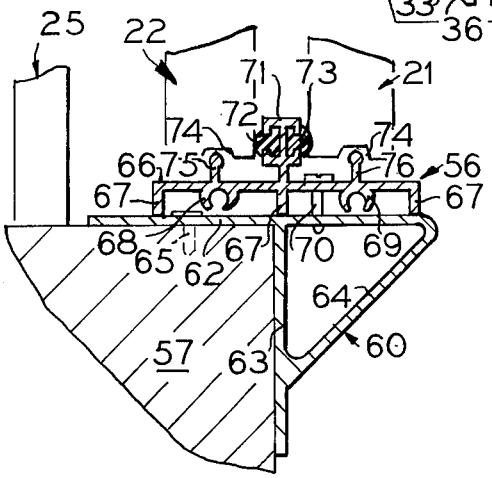
FIG. 6 is a cross-sectional view of a further sill flange piece mounted on a wall opening sill in accordance with the present invention.

In instances, as shown in FIG. 6, a sill 57 is provided in the wall opening that does not adequately protrude from the building wall to support the full width of a frame or door runner piece, a sill extension flange piece 60 may be utilized to provide the extra surface necessary to contain the lateral bottom portion of the inventive mounting frame. FIG. 6 illustrates the too short sill 57 contained in the wall 24 for mounting the patio storm door frame 23. The sill extension piece 60 is preferably made of extruded aluminum, generally of a L-shaped longitudinal profile. The sill extension piece 60 has an upper planar surface 62, a portion of which overhangs the top of the sill 57. Extending downwardly from an intermediate point along the base surface 62 is a mounting wall 63 adapted to press flush against the front sidewall of the sill 57. A diagonal support wall 64 extends between the vertical wall 63 and the outer free edge of the base wall 62. The sill extension flange 60 is fixedly mounted to the sill 26 by means of suitable concrete bolts or nails, such as shown at 65.

The door runner piece 56 is positioned on top of the sill flange base wall 62 in order that it may overhang the front wall of the sill 57. The runner piece 56 is preferably made of extruded aluminum with a horizontal base wall 66 having a plurality of laterally spaced, vertical support walls 67 for resting against the upper surface of the sill flange base wall 62. The spaces between the runner piece support walls 67 are intended to substantially coincide with the mounting grooves 45 and 46 of the upright frame pieces positioned in the wall opening. A longitudinally extending channel member 68 and 69 extends downwardly from the runner base wall 66 in the spaces between the support walls 67, in the manner of the channel members 53 and 54 respectively employed in the lateral frame pieces, to coincide with the lower end screw holes 52 formed on the upright frame pieces to permit aligned connection of the runner piece 61 with the upright frame pieces in the manner discussed above. The runner piece 61 is fixedly mounted to the sill flange 60 by means of suitable metal bolt or screw connectors, such as shown at 70. The upper surface of the runner base wall 66 is formed with a centrally disposed guide wall 71 having laterally opposed, longitudinally extending suitable recesses for containing elastic seal liners 72 and 73 for supporting and guiding sliding movement of the storm door panels 22 and 21, respectively within the corresponding mounting grooves 46 and 45 of the frame assembly. The lower edges of the door panels are formed with bearing surfaces 74 which support the panels for sliding movement along cooperating runner skids 75 and 76 extending upwardly from the top of the runner base wall 66.

The two piece construction of the frame and flange pieces permits adjustable relative positioning of the framework 23 along the exterior edge surfaces of the wall opening to enable installation of the patio storm door 20 at an acceptable clearance from the prime patio door 25. In many instances, the original wall opening does not lend itself to ready installation of a storm door assembly since there is insufficient clearance exterior of the prime door within which to contain the full width of a storm door. For example, with reference to FIG. 3, the prime patio door 25 contains typical handle means 80 which protrude exteriorly of the prime patio door panels taking up a considerable portion of the exterior clearance space left in the wall opening. Installation of the patio storm door 20 requires that the storm door panels and the interior facing surfaces of the mounting frame 23 be positioned at a safe proximate distance exterior of the outermost surface portions of the prime door, usually defined by the door handle 80 of the outermost prime patio door panel. The adjustability of the relative positioning of the flange and frame pieces, as well as use of the sill extension flange piece, in accordance with the present invention enables the installer to immediately adapt the framework for the intended storm glass assembly within the wall opening within a space sufficiently clear of the prime window or door assembly.

FIGS. 3 and 7–11 illustrate six individual relative positions of the flange and frame pieces 30 and 31 for variably adapting a storm glass assembly, here being a patio storm door, along the clearance edge surfaces of the wall opening for the prime assembly, here being a prime patio door. It will be understood that the provision for six different relative positionings is merely illustrative and that the flange and frame pieces of the present invention may be adapted for more or less different positions. Each channel pairs with a second adjacent one of the remaining channels which is in mirror image relation to that channel to define a mounting track for engagingly receiving the ribbings 34 and 35, as shown by these figures. Thus, the frame piece 31 is able to provide three overlapping mounting tracks in a space substantially only two times the width of a mounting track.

Figure 7:
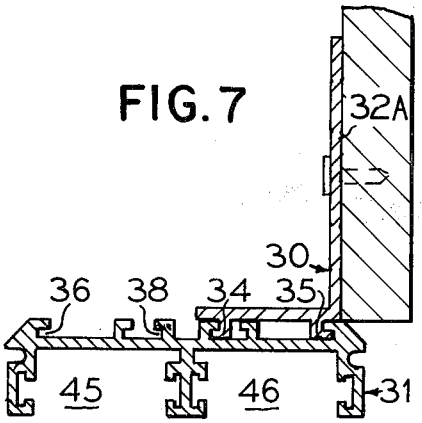
FIGS. 7–11 are plan, cross-sectional views of a pair of support flange and frame pieces for mounting a patio storm door according to the present invention in six variable relative positions.
Figure 8:
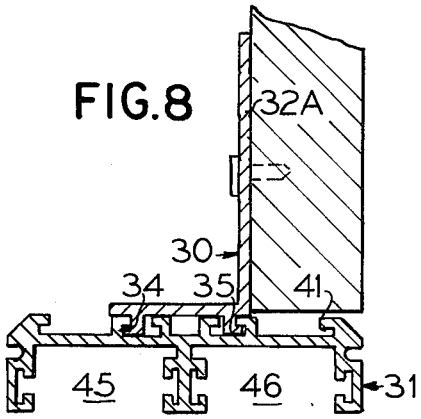

FIGS. 3, 7, and 8 show three different relative positions for mounting the frame pieces 31 when the wall surface 32A of the flange piece 30 is placed flush against the exterior of the brick wall 24. FIG. 7 illustrates the positioning of the frame piece 31 when the wall opening leaves very little exterior clearance within which to mount a storm glass assembly. FIGS. 3 and 8 show frame piece positions in instances when the wall opening affords greater degrees of clearance exterior of the prime assembly.

Figure 9:
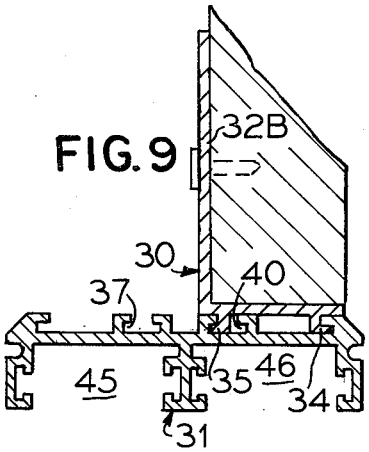
Figure 10:
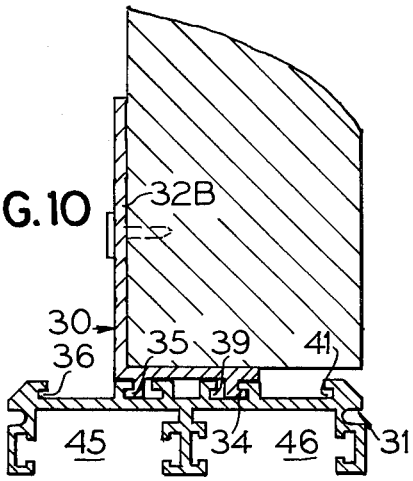
Figure 11:
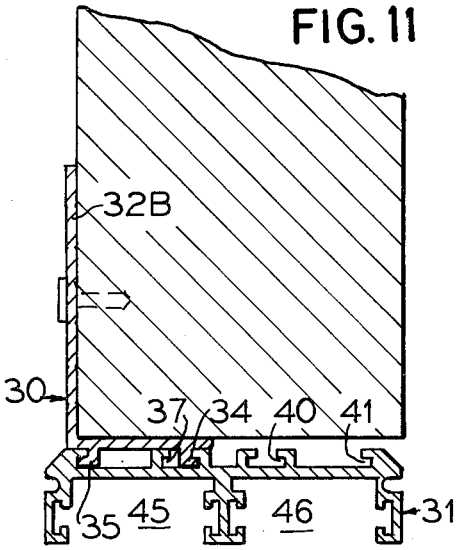

FIGS. 9–11 illustrate three different relative positions for mounting the frame piece 31 when the wall surface 32B of the flange 30 is placed flush against the exterior of the brick wall 24. FIG. 11 shows the position of the frame piece 31 when a relative high degree of exterior clearance with the prime assembly is left in the wall opening. FIGS. 9 and 10 show frame piece positioning in instances when the wall opening affords less degrees of clearance exterior of the prime assembly.

Figure 12:
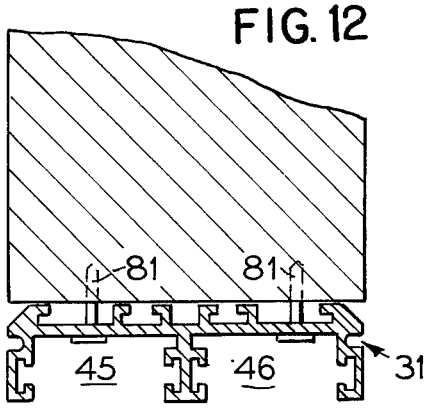
FIG. 12 is a plan, cross-sectional view of a frame piece mounting a patio storm door according to the present invention placed flush against a wall edge, without the use of a support flange.

FIG. 12 illustrates a further option of using the frame pieces 31 without the flange members 30. In such situations, the necessary clearance for mounting the storm glass assembly is contained within the wall opening, such that the frame pieces may be fixedly attached by suitable concrete bolts or nails 81 directly to the clearance edges defined along the wall opening.

Although various minor modifications may be suggested by those versed in the art, it should be understood that I wish to embody within the scope of the patent warranted hereon all such modifications as reasonably and properly come within the scope of my contribution to the art.

I claim as my invention:

1. An adjustable framework system for mounting a storm glass assembly adjacent a prime assembly contained within a preformed wall opening comprising first and second separate, interconnectable pieces, said first piece being a flange having first and second surfaces connected together at an angle along a common edge, said first surface having opposed planar sides for alternately facing flush against the exterior of said wall surrounding said opening, said second surface having a planar exterior side facing said first surface and an opposed interior side formed with a pair of longitudinally extending L-shaped plan profile ribbings which are in mirror image relation to one another, and said second piece being a frame having a first side facing said second surface interior side formed with longitudinally extending L-shaped plan profile channel members comprising at least a pair of end channel members disposed respectively at opposite ends of said first side in mirror image relation to one another and two spaced-apart pairs of adjacent intermediate channel members disposed between said end channel members, each pair of intermediate channel members being in mirror image relation to one another, and said frame having a second side facing into said opening formed with longitudinally extending mounting means for supporting said storm glass assembly for sliding movement in said opening, each said channel member pairing with a second adjacent one of the remaining channel members which is in mirror image relation to that each said channel member to define a mounting track for engagingly receiving said ribbings such that plural alternative said mounting tracks are provided overlapping one another for selective adjustable positioning of said frame on said flange in said opening.

2. The apparatus of claim 1, further comprising an extension flange piece for overhanging a sill member of said wall at the base of said opening and a base frame piece secured to an upper surface of said extension flange piece for supporting the lower end of said storm glass assembly.

3. The apparatus of claim 1, wherein said storm glass assembly is a patio storm door and said prime assembly is a prime patio door.

4. The apparatus of claim 1, wherein said flange first and second surfaces are substantially perpendicular to one another.

* * * * *